US005646635A

United States Patent [19]

Cockson et al.

[11] Patent Number: 5,646,635

[45] Date of Patent: Jul. 8, 1997

[54] PCMCIA ANTENNA FOR WIRELESS COMMUNICATIONS

[75] Inventors: Mark G. Cockson, Roca; Stephen L. Prochaska; Kenneth D. Simmons, both of Lincoln, all of Nebr.

[73] Assignee: Centurion International, Inc., Lincoln, Nebr.

[21] Appl. No.: 516,400

[22] Filed: Aug. 17, 1995

[51] Int. Cl.[6] ..... H01Q 1/24

[52] U.S. Cl. ..... 343/702; 343/700 MS; 343/872; 343/882; 343/906; 343/901

[58] Field of Search ..... 343/700 MS, 702, 343/846, 872, 888, 901, 906, 882, 715; H01Q 1/24, 1/38

[56] References Cited

U.S. PATENT DOCUMENTS

| | | | |
|---|---|---|---|
| 3,349,405 | 10/1967 | Wright | 343/702 |
| 4,136,344 | 1/1979 | Nakao et al. | 343/901 |
| 5,014,346 | 5/1991 | Phillips et al. | 343/702 |
| 5,361,061 | 11/1994 | Mays et al. | 343/702 |
| 5,402,135 | 3/1995 | DeMarre et al. | 343/882 |
| 5,451,965 | 9/1995 | Matsumoto | 343/702 |

*Primary Examiner*—Donald T. Hajec
*Assistant Examiner*—Tan Ho
*Attorney, Agent, or Firm*—Zarley, McKee, Thomte, Voorhees & Sease; Dennis L. Thomte

[57] ABSTRACT

A PCMCIA antenna for wireless communications is provided which provides the performance of a ½ wave antenna used for wireless communication, both transmission and receiving, on PCMCIA and other platforms for wireless data communications. The antenna comprises a housing which is adapted to be secured and supported by the host device and comprises a housing including housing members which are ultrasonically welded together. A flexible circuit board is provided in the housing which serves as the lower radiating element. A coaxial cable extends into the housing and has its braid soldered to the lower radiating element so that the same serves as a counterpoise for the antenna. The center wire of the coaxial cable is connected by a flexible trace to a flexible printed circuit board which is encased in an insulated sheath which forms the upper radiating element. The upper radiating element is pivotally secured to the housing so that the upper radiating element may be moved to a stowed position wherein it is parallel to the longitudinal axis of the housing, where it may be pivotally moved upwardly with respect to the housing to a 90 degree angle with respect to the housing.

9 Claims, 9 Drawing Sheets

PCMCIA ANTENNA FOR WIRELESS COMMUNICATIONS

BACKGROUND OF THE INVENTION

1. Field of the Invention

This invention relates to an antenna for wireless communications, and more particularly to a PCMCIA antenna for wireless communications. In particular, the antenna of this invention is designed to provide a compact, portable, full-performance antenna on a small platform of a PCMCIA card which has the same performance as a 6.5 inch long ½ wave antenna, thereby providing greater flexibility, portability and product marketing ability.

2. Description of the Related Art

This invention relates to antennas for use with wireless data communications, and portable communications in general, that typically use the PCMCIA (Personal Computer Memory Card Interface Association) Standards. These devices are commonly used with portable computing devices including, but not limited to, palm-top computers, lap-top computers, PDA (personal digital assistants) and/or other devices developed to enhance productivity. The limitation of these devices is current interface with an existing host computer system to exchange data requiring a hard-wire telephone line. This, however, does not work well with an individual who is, for example, travelling, typical of a salesperson. This invention is used with wireless communication modules that can be interfaced with the PCMCIA socket on one of the aforementioned devices. These wireless modules will transmit and/or receive data from selected sites to provide updates for information and real-time access to data. Because of this communication technology, the antenna is required to accomplish this feat.

The most popular frequencies for these types of applications are currently between 806 MHz and 941 MHz, although this concept may be used on a wide variety of frequencies. The PCMCIA card, with its physical size expressed as a function of wave length, requires an antenna significantly larger than the PCMCIA form factor will allow. Therefore, it is necessary to have an antenna which can be extended to maintain maximum performance and minimize the ground plane and shielding effects of the host device as additional frequencies become available for wireless LAN, WAN or for other applications, up to and including 5.8 GHz.

The only products that are currently being offered for this particular application of which applicants are aware, are helically loaded monopoles. Radiation patterns the helically loaded monopoles are influenced by the ground plane offered by the host device. They also induce RF currents on the chassis which can create problems, interference, etc., with RF currents, desensitization and RF currents flowing on the case that affect both the RF circuit and the digital logic circuit inside of the host device and the PCMCIA platform.

SUMMARY OF THE INVENTION

Figure 1:
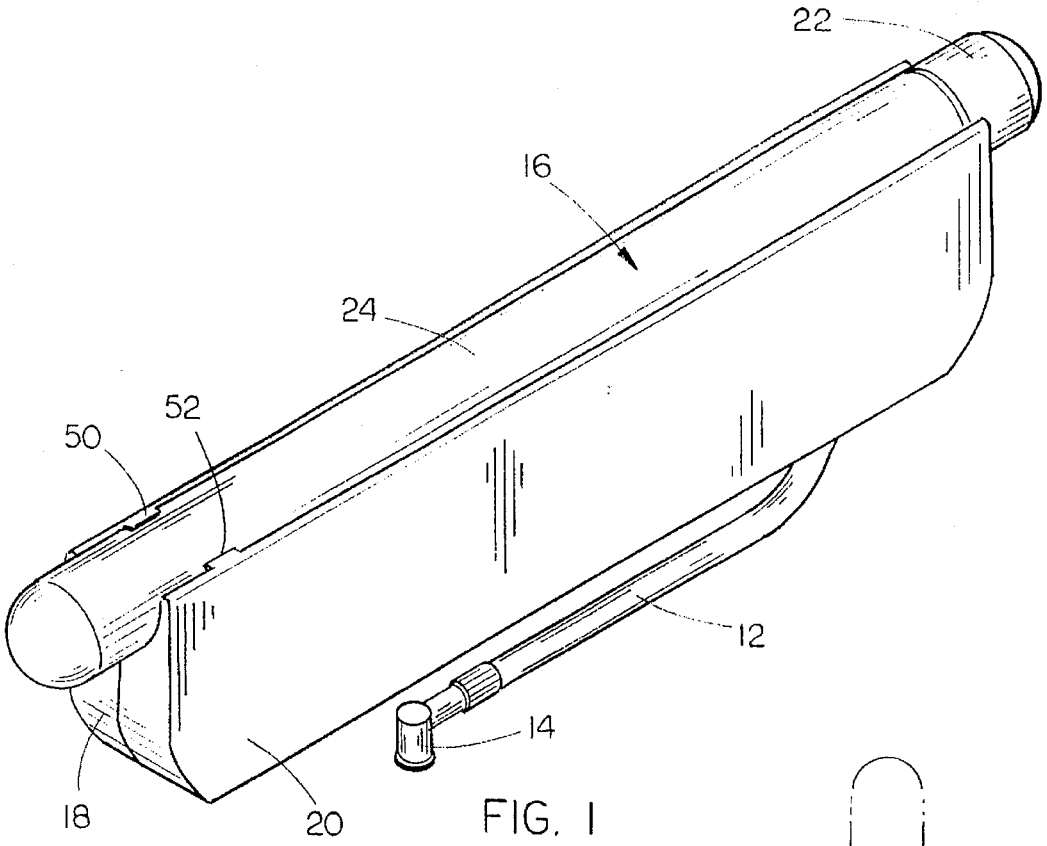
FIG. 1 is a perspective view of the PCMCIA antenna in the stowed or down position.
Figure 2:
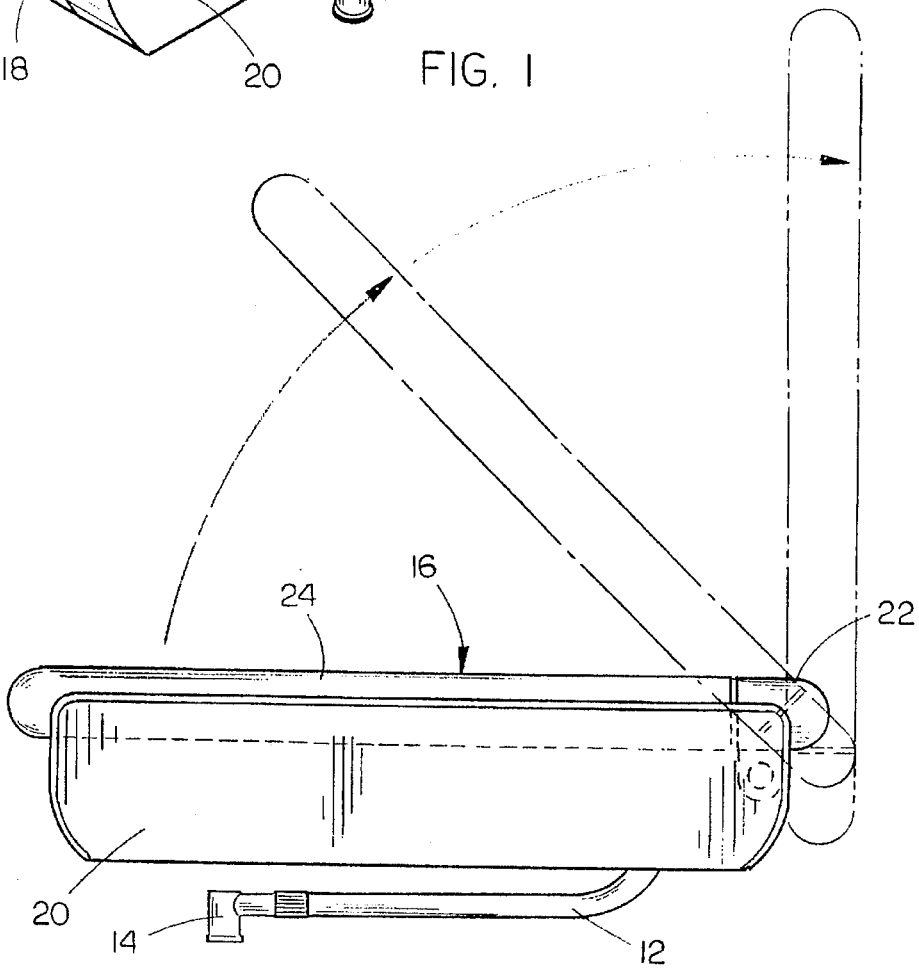
FIG. 2 is a side view of the antenna of FIG. 1 with the broken lines illustrating the antenna in various positions of its movement.

A PCMCIA antenna for wireless communications is provided which provides the performance of a ½ wave antenna used for wireless communication, both transmission and receiving, on PCMCIA and other platforms for wireless data communications, minimizing the interference with digital signals on the PCMCIA card. The antenna comprises a housing which is adapted to be secured and supported by the host device. In the preferred embodiment, the antenna comprises a housing including housing members which are adapted to be ultrasonically welded together. In the preferred embodiment, a flexible circuit board is provided in the housing which serves as the lower radiating element. A coaxial cable extends into the housing and has its braid soldered to the lower radiating element so that the same serves as a counterpoise for the antenna. The center wire of the coaxial cable is connected by a flexible trace to a flexible printed circuit board which is encased in an insulated sheath which forms the upper radiating element. The upper radiating element is pivotally secured to the housing by means of a knuckle joint so that the upper radiating element may be moved to a stowed position wherein it is parallel to the, longitudinal axis of the housing, or it may be pivotally moved upwardly with respect to the housing to either a 45 degree angle or to a 90 degree angle with respect to the housing so that the antenna is fully deployed. In a modified form of the antenna, the upper radiating element consists of two members pivotally secured together. In yet another embodiment of the invention, the upper radiating element consists of a tube having a wire member telescopically extending therefrom.

It is therefore a principal object of the invention to provide a compact, portable, full-performance antenna on a small platform of a PCMCIA card which has the same performance as a 170 mm long ½ wave antenna.

Yet another object of the invention is to provide a PCMCIA antenna which is provides greater flexibility, portability and product marketing ability.

Yet another object of the invention is to provide a PCMCIA antenna which may be used in a stowed position or which may be used in a position wherein it has been pivoted upwardly 90 degrees so that it is perpendicular to the longitudinal axis of the PCMCIA platform.

Yet another object of the invention is to provide a PCMCIA antenna which may be extended to maintain maximum performance and minimize the ground plane and shielding effects of the host devices as additional frequencies become available for wireless LAN, WAN or for other applications, up to and including 5.8 GHz.

Yet another object of the invention is to provide a PCMCIA antenna which is economical to manufacture, refined in appearance and durable in use.

These and other objects will be apparent to those skilled in the art.

DESCRIPTION OF THE PREFERRED EMBODIMENT

The preferred antenna embodiment of this invention is illustrated in FIGS. 1–6 wherein the antenna is represented by the reference numeral 10. Antenna 10 includes a coaxial cable 12 having an RF coaxial connector (OSMT, MMCX or other connector) 14 at one end thereof. The coaxial cable 12 transmits energy from the device to the antenna during transmitting, and from the antenna to the host device during receiving. Antenna 10 includes a plastic housing 16 comprised of housing members 18 and 20. A plastic knuckle joint 22 is mounted on the housing 16 as will be described in more detail hereinafter. Antenna 10 also includes a non-conductive sheath or covering 24 which encloses the upper radiator 26 of the radiator 28. Radiator 28 also includes a lower radiator 30, as seen in the drawings. Both the upper and lower radiators 26 and 30 have conductive serpentine traces provided thereon in conventional fashion. The radiators 26 and 30 are flexible and are preferably comprised of a metallic conductor attached to a flexible substrate, for example, a copper conducting trace on a flexible (Kapton®) polyimide substrate forming a common flexible circuitry material. The serpentine trace is selected to provide the options inductance, capacitance and distributed capacity between traces to provide optimal matched conditions to the circuitry to which it is attached. As stated, the coaxial connector 14 is attached to the RF circuit of the host device. The coaxial cable 12 carries the signal from the center conductor of the host circuit board to the center feed point 32 on the radiator 28 which is in the form of a flexible circuit board. The transitionary component 34 connects the upper and lower radiator elements 26 and 30. Transitionary component 34' is preferably a thin trace transferring the center wire 36, or center feed of the coaxial cable, to the upper radiator 26. Variations of the transitionary component 34 are possible and could vary between a solid connecting component or a two-piece flexible device. Thus, the electromagnetic energy passes from center wire 36, through transitionary component 34 and into the upper radiator 26. The shield of the coaxial cable 12 is electrically connected by solder or the like to the lower radiator 30 at the center feed point 32. The radiator configuration illustrated in FIG. 3, which is formed by the flexible printed circuit boards 26 and 30, could also be a single-sided circuit board it desirable. However, it is believed that the double-sided circuit board is a more compact and manufacturable design than the single-sided circuit board.

Figure 3:
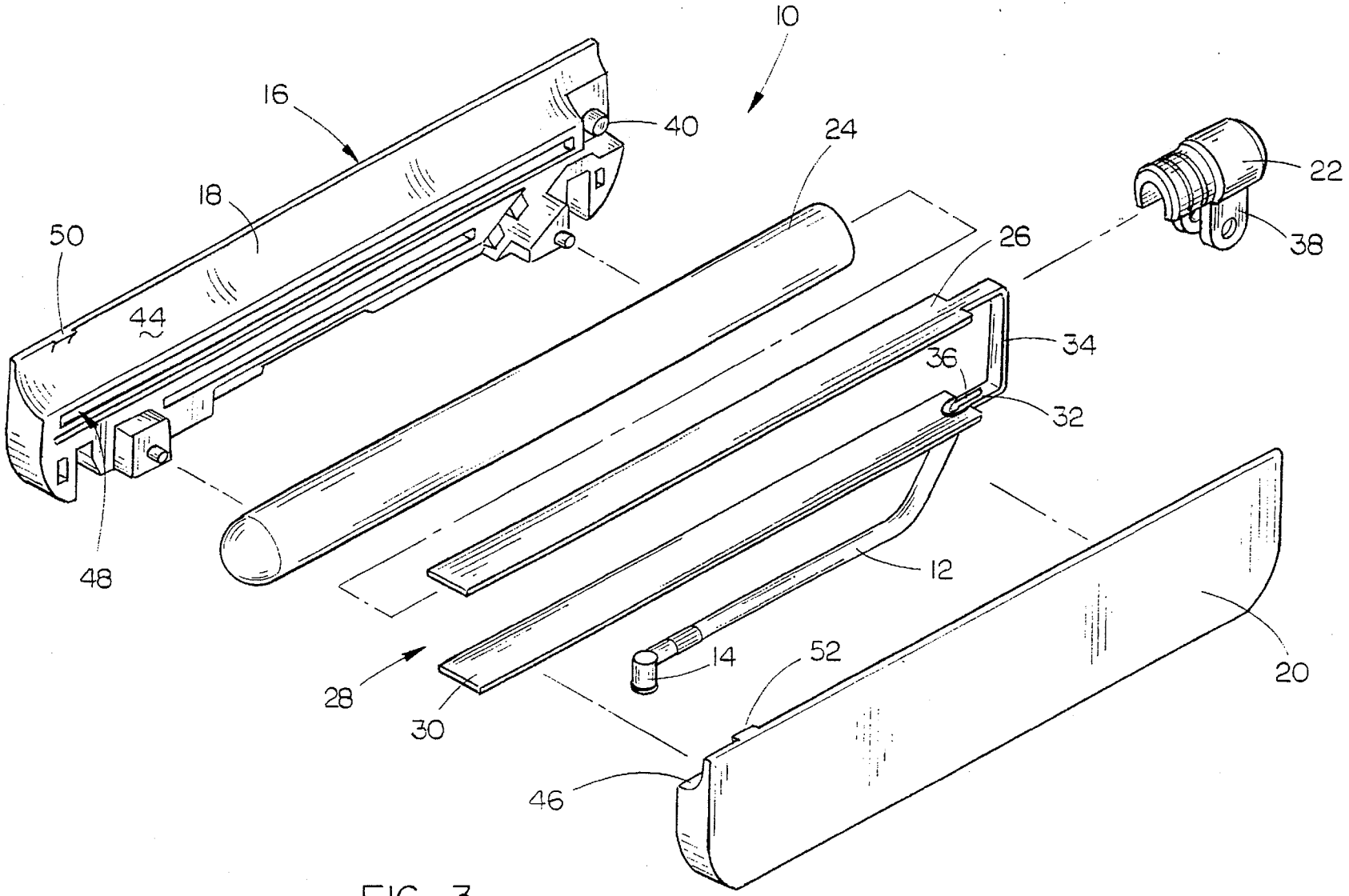
FIG. 3 is an exploded perspective view of the antenna of FIGS. 1–2.
Figure 5:
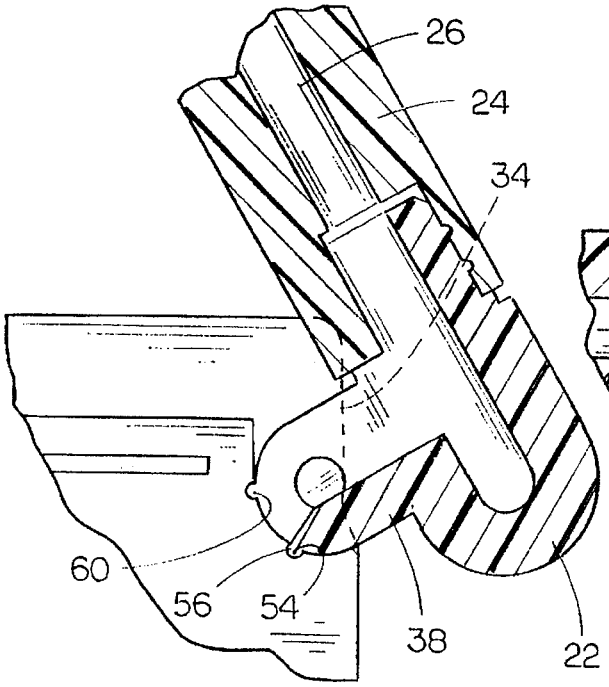
FIG. 5 is a partial sectional view illustrating the antenna in its 45 degree position.
Figure 6:
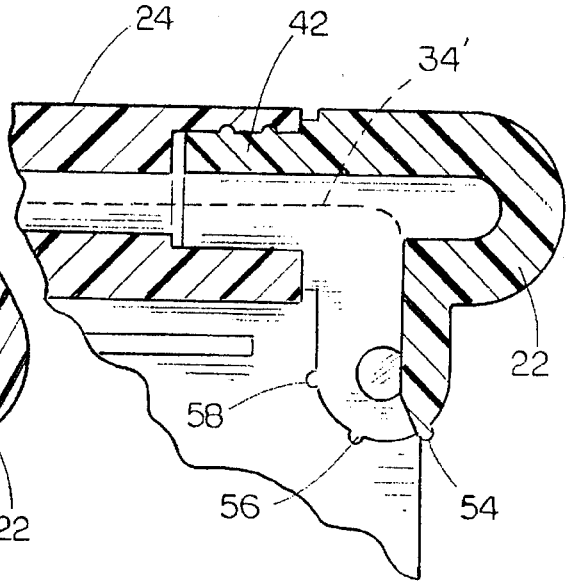
FIG. 6 is a view similar to FIG. 5 except that the antenna is in its stowed position.

The plastic housing 16 is an integral part of the wireless data modem that may be integrated into the host device. The antenna of this invention is not intended as a stand-alone antenna, but rather it is an integrated part of the host device. Preferably, the housing 16 has locking or retaining features molded onto the outside thereof to removably secure it to the host device, either by snap or slide fit. The housing members 18 and 20 are joined together to captivate the circuit traces, coaxial cable 12 and knuckle 22 by means of ultrasonic welding. Knuckle 22 includes an end portion 38 which is pivotally mounted between the housing members 18 and 20 by means of the pin 40 extending inwardly from housing members 18 and 20, as seen in FIG. 3. Knuckle joint 22 also includes an end portion 42 which is received in the lower end of the sheath 24, as illustrated in FIGS. 5 and 6.

As seen in FIG. 3, housing members 18 and 20 are provided with arcuate cut-out portions 44 and 46 formed in the upper ends thereof which are adapted to receive the sheath 24 when the antenna is in its folded or stowed position, as illustrated in the drawings. As also seen in FIG. 3, housing member 18 is provided with an elongated slot 48 formed therein which is adapted to receive and position one side of the lower radiator 30. Although not shown, housing member 20 has a slot identical to slot 48 which receives the other side of the lower radiator 30. As also seen in FIG. 1, housing members 18 and 20 are provided with inwardly extending lips 50 and 52 which are provided to maintain the sheath 24, and upper radiator 26, in the stowed position. This acts as a detent locking the antenna in the stowed position. Knuckle joint 22 is also provided with a detent nub 54 protruding therefrom which is adapted to be received by the detents 56 and 58 formed in either or both of the housing members 18 and 20. As seen in FIGS. 5–16, when detent nub 54 is received by the detent 56, the upper radiator will be maintained in a forty-five degree angle. When detent nub 54 is received by detent 58, the upper radiator will maintained in a ninety degree position. When nub 60 is received by detent 56, the upper radiator will be locked in a stowed position.

In operation, the antenna described herein in FIGS. 1–6 functions as a dipole antenna with a balanced feed system so that the antenna has its own counterpoise system and an individual radiating system. In using the dipole antenna of this invention, the antenna may operate more independently from the wireless data device. A ¼ wave antenna would be dependent upon changes in variation from one fax modem device to another and the ground plane from one host to another. In are unbalanced system, more RF currents are applied to the unit itself and it is more reliable to have a balanced antenna system so that the RF currents are maintained within the dipole system itself and radiate from the antenna and not from the host unit. When the RF currents are not isolated from the host unit and are allowed or required to be flowing on it, as in the case of an unbalanced antenna, such contributes to desensitizing the unit itself and decreasing the efficiency and product coverage/reliability.

The ground independent dipole antenna of this invention accomplishes one of the main purposes of the PCMCIA antenna, which is a small, compact, high-performance antenna independent of the ground characteristics of the host device to which it is attached. A PCMCIA form factor is approximately 53 mm in width. This provides an antenna that may be deployed on a PCMCIA form factor, thus maintaining the portability and convenience factor. When the antenna of FIGS. 1–6 is fully deployed for maximum performance, the antenna height is typically less than the height of the host device in operation, i.e., approximately 70 mm. This is in comparison to a full-size antenna, approximately 170 mm long, and maintains performance approximately that of the full-size antenna.

Figure 9:
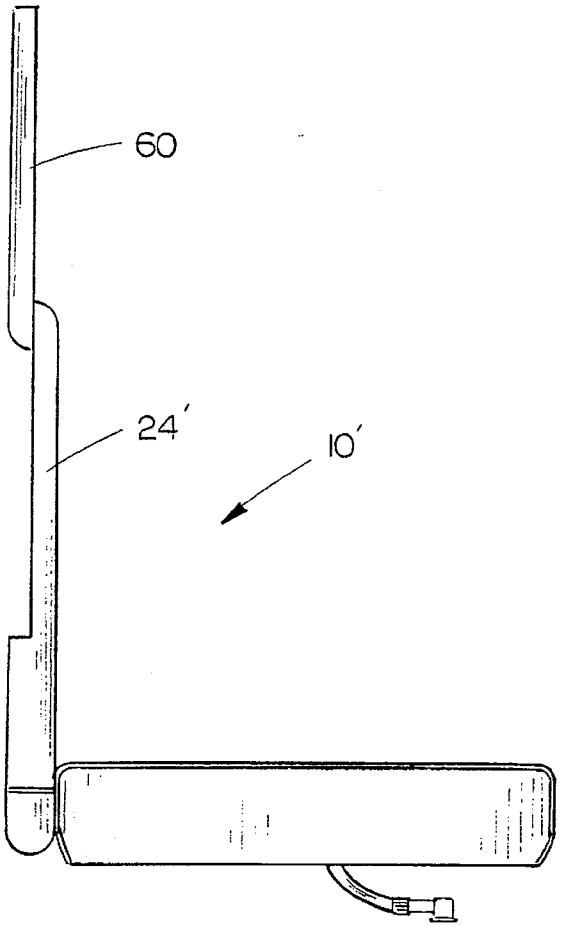
FIG. 9 is a view similar to FIG. 8 except that the antenna has been fully deployed.
Figure 7:
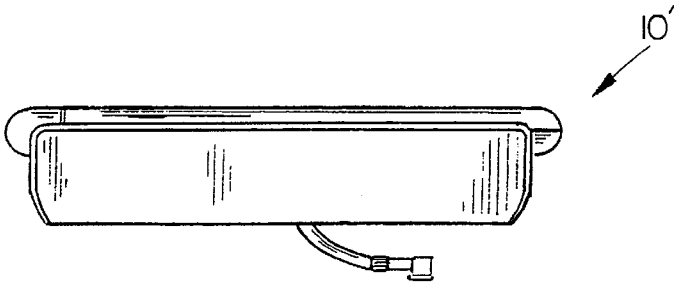
FIG. 7 is a side view of a modified form of the antenna.
Figure 8:
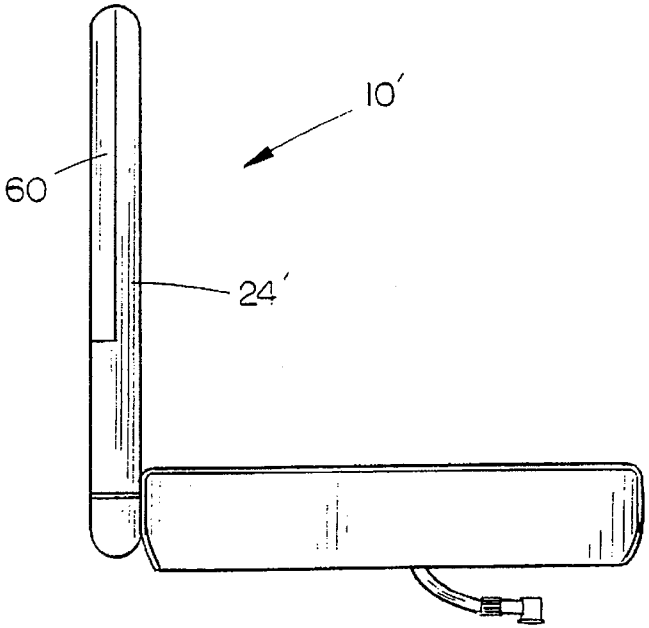
FIG. 8 is a side view of the antenna of FIG. 7 with the antenna in its, vertically disposed position.
Figure 10:
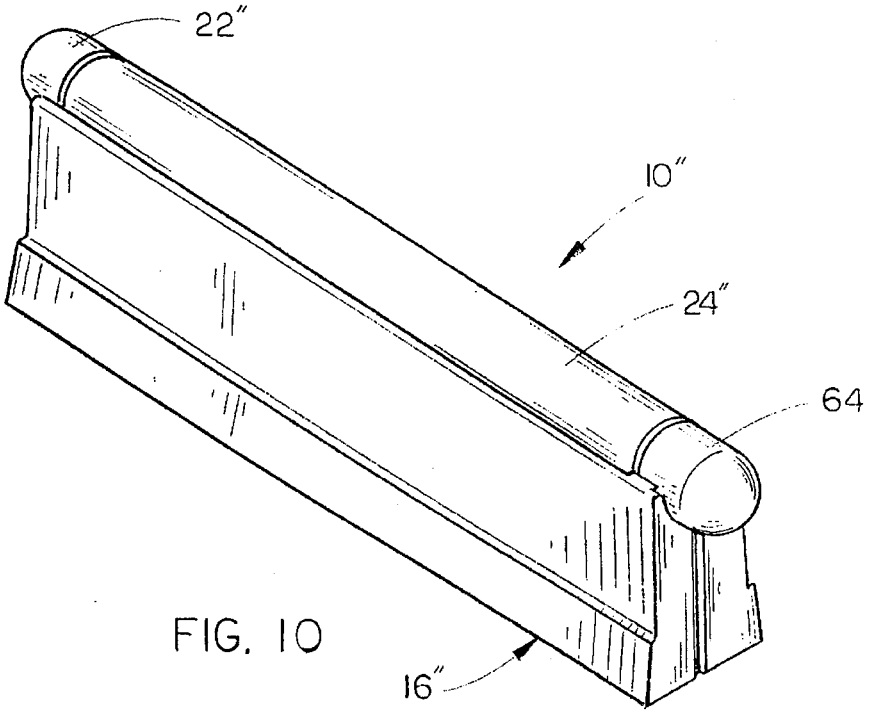
FIG. 10 is a perspective view of a modified form of the antenna.
Figure 11:
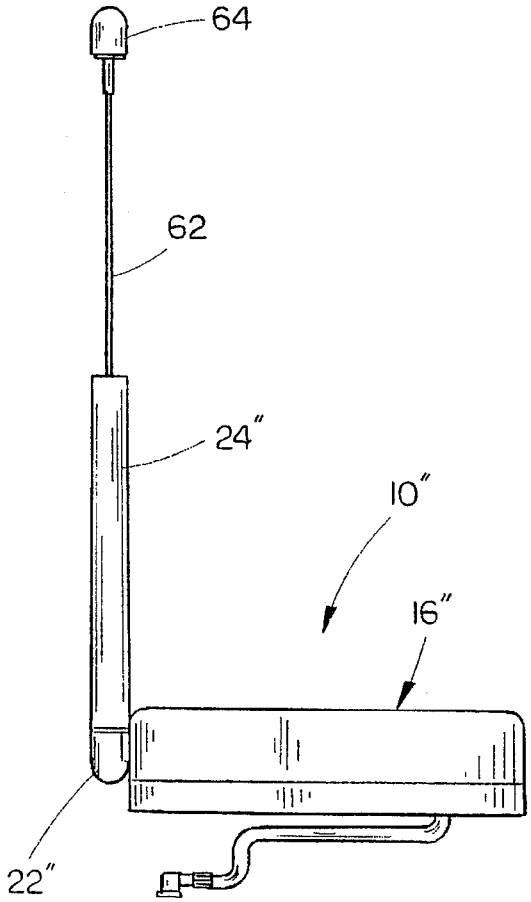
FIG. 11 is a side view of the antenna of FIG. 10 with the antenna in its fully deployed position.
Figure 12:
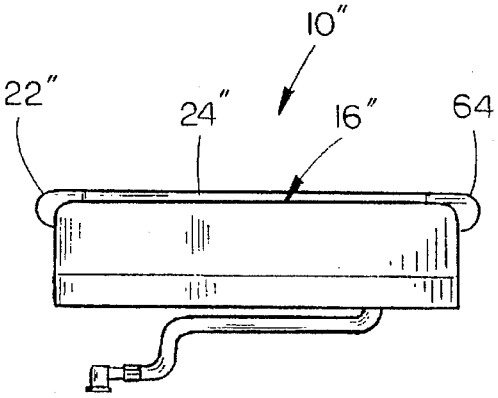
FIG. 12 is a view similar to FIG. 11 except that the antenna is in its stowed position.

FIGS. 7–9 illustrate a variation of the antenna 10'. Antenna 10' is identical to the antenna of FIGS. 1–6 except that the upper radiator 26 enclosed in the sheath 24' includes a portion 60 which is pivotally connected thereto. FIG. 7 illustrates the antenna 10' in the stowed position, while FIG. 8 illustrates the antenna 10' in its extended position. FIG. 9 illustrates the antenna 10' in its fully deployed position wherein the portion 60 has been pivotally moved from the position of FIG. 8 to the position of FIG. 9. The antenna 10' may be provided in one of two form factors, namely: (1) a dipole with extendible elements; and (2) an end fed ½ wave with integral matching circuit. The antenna of FIGS. 1–6 previously described herein is electrically loaded to condense the electrical ½ wave into the available physical package resulting in performance degradation, namely effective radiated power, pattern shadowing and influence of the host device. To overcome those concerns for users who must maintain maximum performance, the antenna 10' is offered. Antenna 10' operates at maximum efficiency providing the user with the best possible range and signal strength, both in transmitting and receiving, when element 60 is extended (rotated) vertically, as depicted in FIG. 9. The interior base construction of the antenna 10' may be that illustrated in FIG. 11 (using coaxial dipole counterpoised) or in FIG. 3 (using a flex board). The antenna 10' provides a full-size physical and electrical antenna element when in the extended position to provide the primary advantage of improved performance with less shadowing from the host device.

Figure 17:
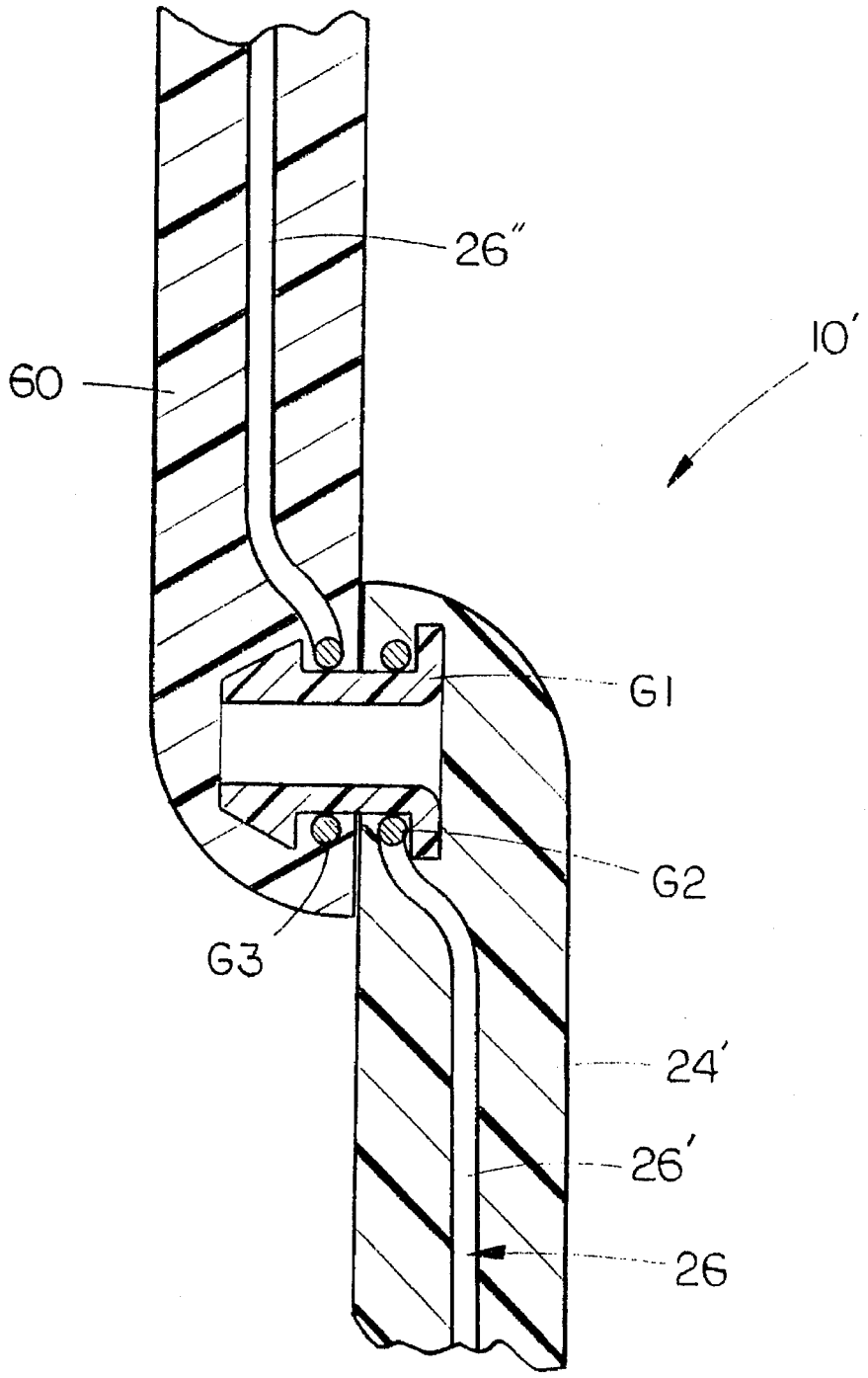
FIG. 17 is a partial sectional view of the antenna of FIGS. 7–9.

FIG. 17 illustrates the connection between the upper and lower portions of the upper radiator 26. As seen in FIG. 17, G1 designates an electrically conductive insert molded grommet while G2 and G3 represent electrically conductive snap rings embracing grommet G1. More particularly, the sheath 24' is insert molded onto the grommet G1. Grommet G1 is attached to the radiator by means of riveting or soldering, with the molded sheath assembly inserted into the upper sheath 60. The center conductor 26 is routed into upper sheath 60 to provide a full-size physical and electrical antenna element when in the extended position. The conductor 26 attached to the lower radiating element 24' electrically and mechanically by means one of the snap rings G2, thereby transferring electrical current from 26' through conductive grommet G1 into the other snap ring G2 and finally to the upper radiating element 26".

Figure 13:
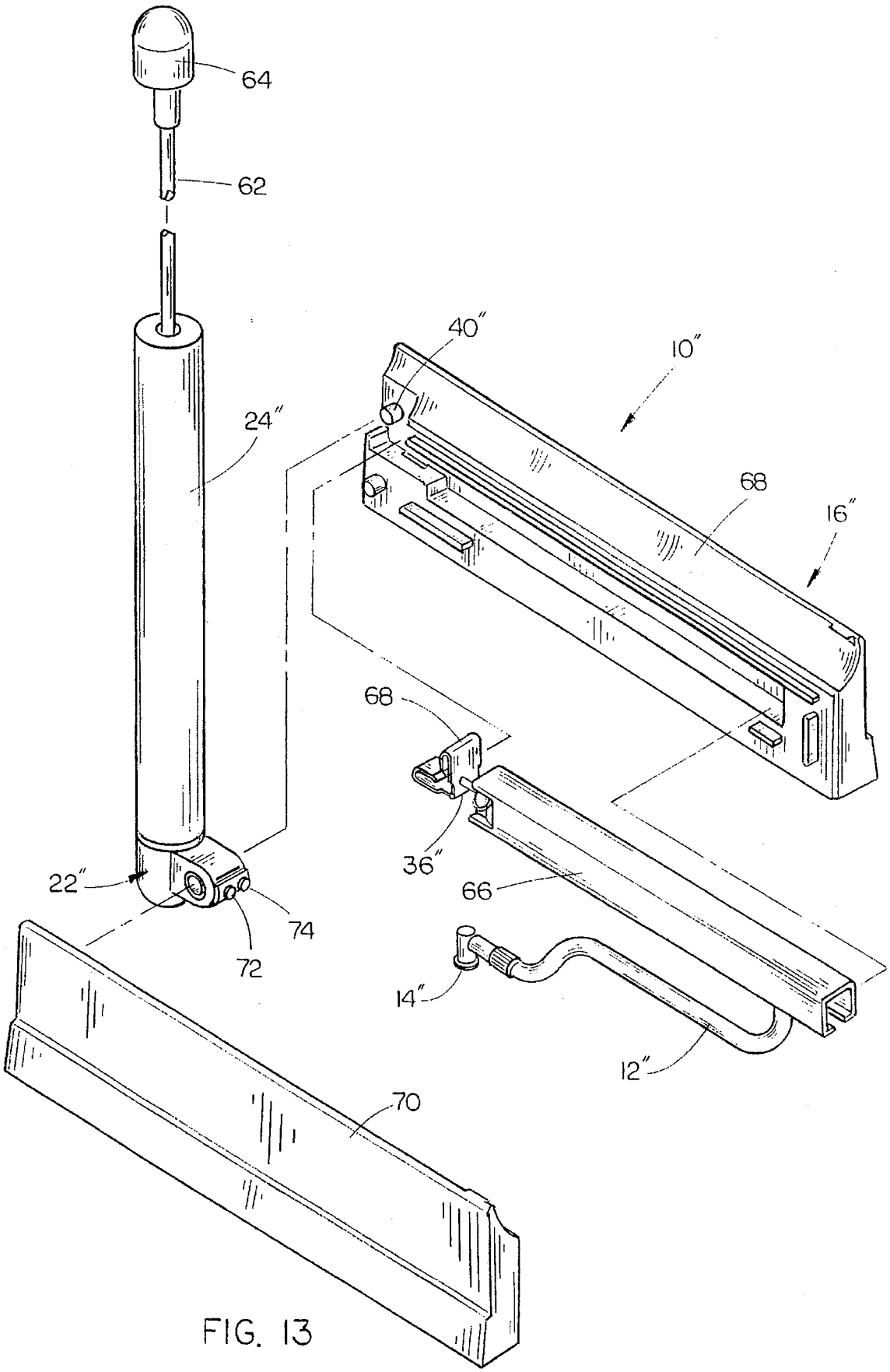
FIG. 13 is a partially exploded perspective view of the antenna of FIGS. 10–15.
Figure 14:
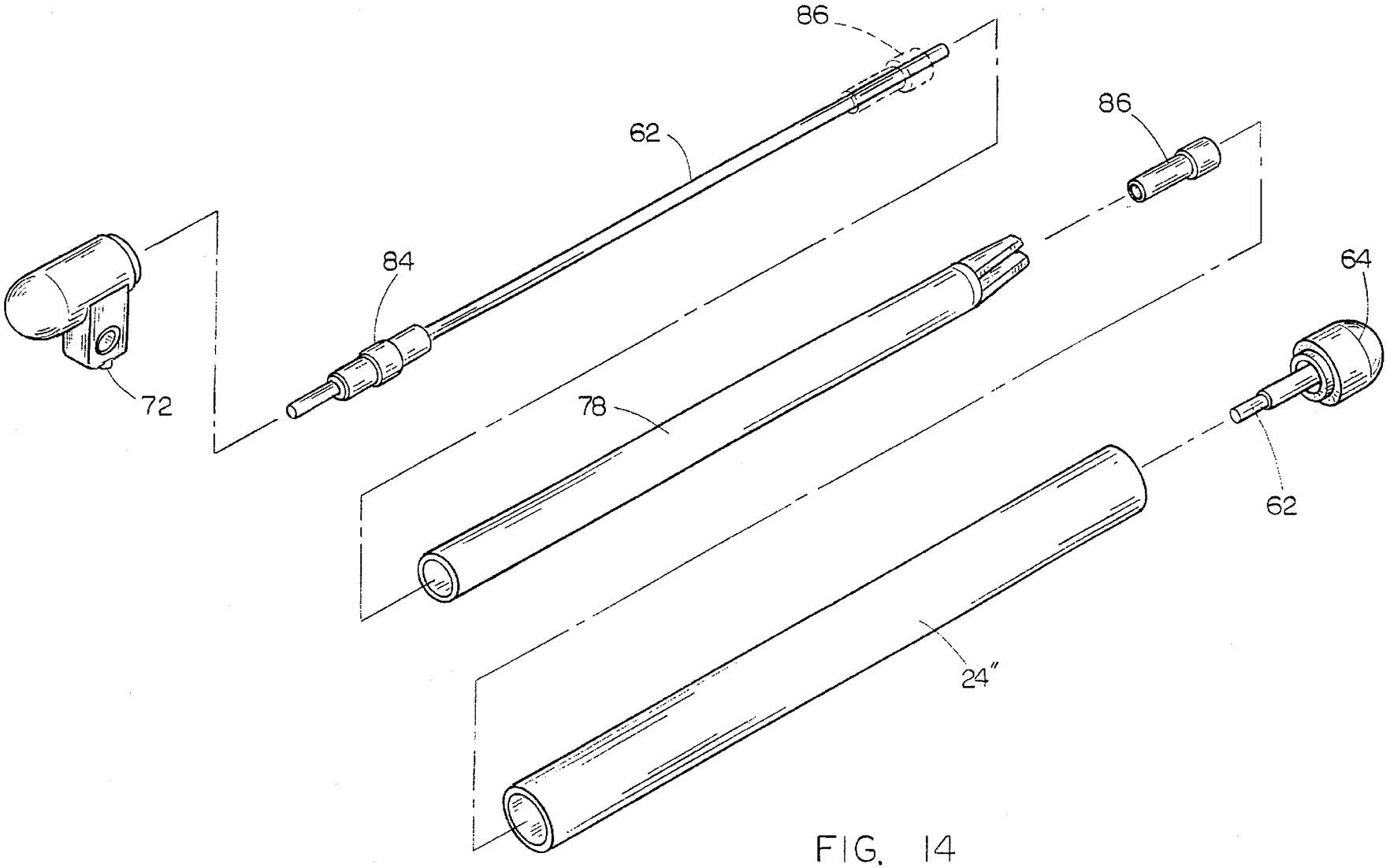
FIG. 14 is an exploded perspective view of the upper radiator of the antenna of FIGS. 10–14.
Figure 15:
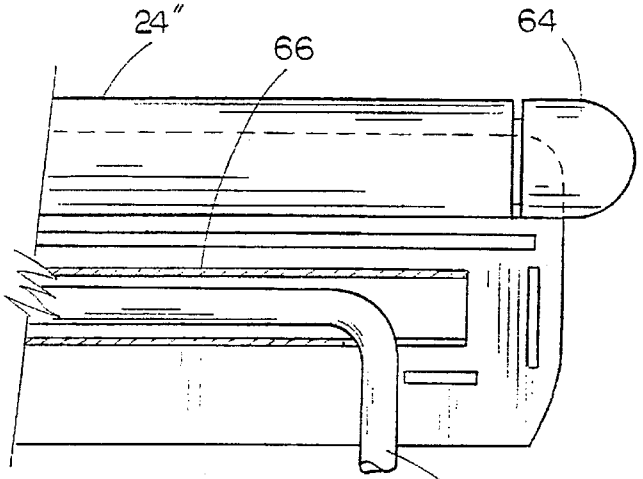
FIG. 15 is a partial longitudinal sectional view of the antenna of FIGS. 10–15.

FIGS. 10–15 illustrate yet a further modified form of the antenna. The antenna 10" of FIGS. 10–15 is essentially identical to the antenna 10 of FIGS. 1–6 except that the upper radiator includes the sheath 24' having wire 62 telescopically extending therefrom. The housing 16" encases the lower half of the dipole. The swivel knuckle 22" rotates the antenna's upper radiator to a vertical position, as illustrated in the drawings. The wire 62 which telescopically extends from the sheath 24" terminates in a top bushing which is beneath the cap 64. The details of the antenna 10" are more fully illustrated in FIGS. 13–15. An exploded perspective view of the antenna 10" is illustrated in FIG. 13 and will now be described. The antenna 10", as previously described, is a center fed coaxial ½ wave antenna. The numeral 14" refers to the RF connector which is connected to the coaxial cable 12". Coaxial cable 12" is routed through the lower radiating element 66, as illustrated in FIG. 15, with the center wire 36" being in electrical contact with the flexible metal contact 68. The knuckle joint 22" is pivotally mounted on the pin 40" positioned on housing member 68 of housing 16". The numeral 70 refers to the other housing member of housing 16".

Figure 4:
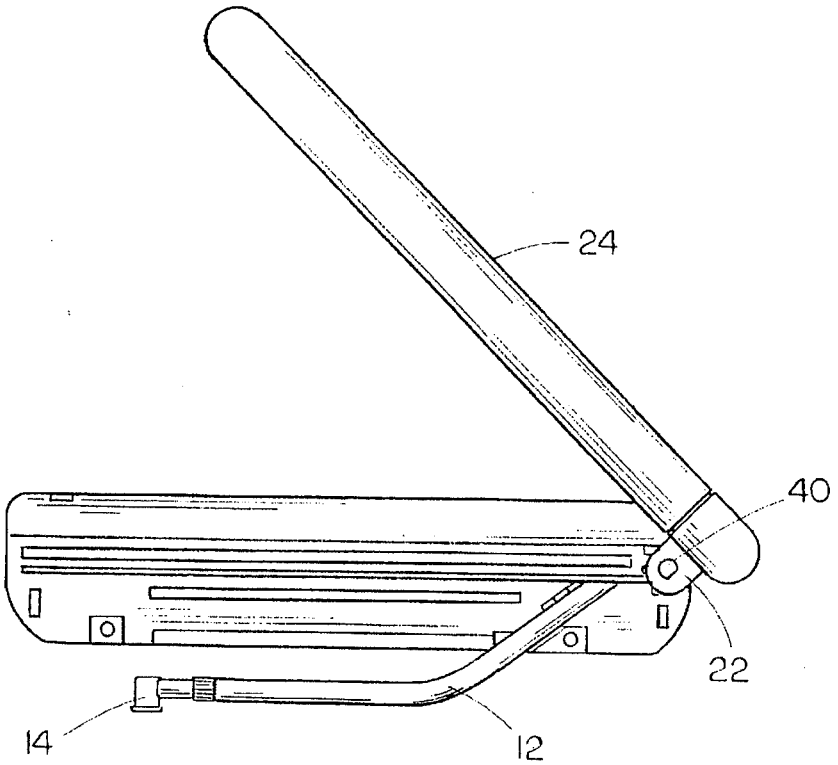
FIG. 4 is a longitudinal sectional view of the antenna of FIGS. 1–3.

As seen in FIGS. 14 and 15, the center conductor 36" is soldered to the flexible contact 68. Knuckle joint 22" includes a pair of electrical contacts 72 and 74 which are adapted to make electrical contact with the leg **68*a* of contact 68 when the antenna is in its vertical position, as illustrated in FIG. 4, and which is adapted to make electrical contact with the leg 68*b* of contact 68 when the antenna is in the stowed position, as illustrated in FIG. 15. The braid of the connector 12 is secured to the radiator 66 at 72 by soldering or the like. The numeral 74 refers to the insulator covering the center conductor 36"**.

As seen in FIG. 13, the upper radiator is comprised of the sheath 24" which is comprised of elastomer material. The wire 62 is preferably comprised of a nickel-titanium wire which extends upwardly from the sheath 24". The contacts 72 and 74 extend inwardly into the overmolded knuckle 22", as illustrated in FIG. 14. The inner ends of the contacts 72 and 74 are in electrical contact with a brass tube 78 encased in the sheath 24". The metal wire 62' is telescopically mounted in the brass tube 78'. As previously stated, the upper end of the wire 62 terminates in a metal bushing which is encased in the overmolded cap 64.

The operation of the antenna of FIGS. 10–15 is as follows: The RF signal is fed into the coaxial connector 14" and through the coaxial cable 12" which continues through the lower radiating element 66. The center point feed point is connected to the contact 68 which in turn makes contact with brass tube 78. The brass tube is in contact with the telescoping wire 62. In the fully deployed position, the contacts 72 and 74 are in electrical contact with leg **68*a* of flexible contact 68. When the antenna is in its stowed position, the contacts 72 and 74 are in electrical contact with the leg 68*b* of flexible contact 68. Not only is electrical contact made between the contacts 72 and 74 and the legs 68*a* and 68*b***, but the contact also serves as a mechanical contact so as to maintain the antenna in its stowed position or in its deployed position. Thus, the arrangement eliminates the position connection of the coaxial cable flexing, thus eliminating any work-hardening due to flexing in the multiple cycles. The miniature or small design permits it to be housed in a very small package.

Figure 16:
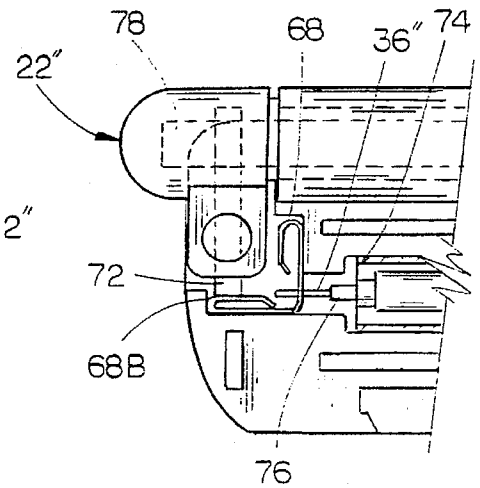
FIG. 16 is a partial sectional view illustrating a modification of the antenna of FIGS. 10–14.
Figure 16:
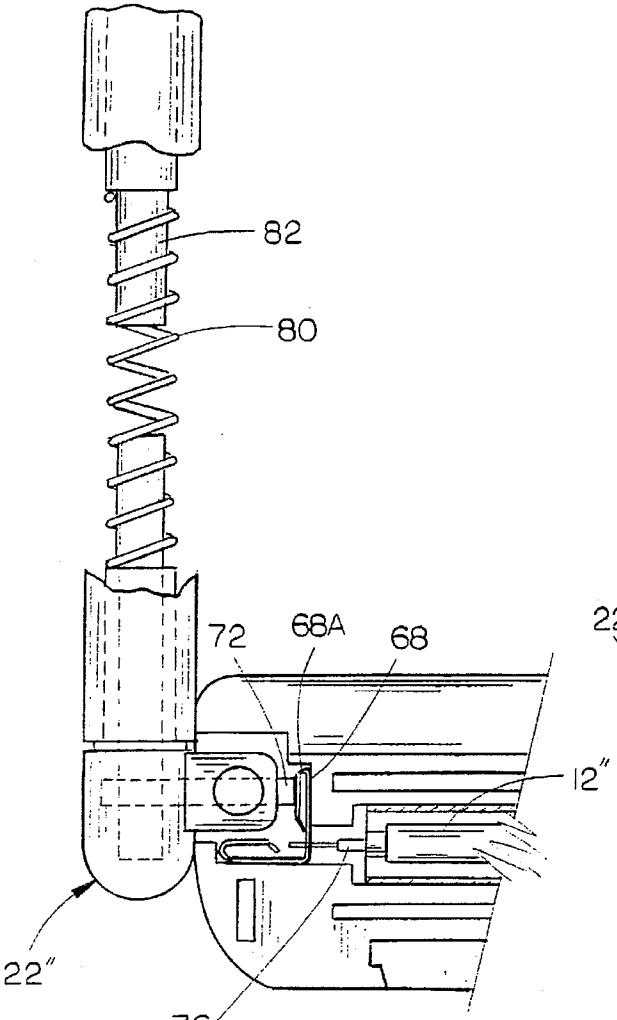

FIG. 14 illustrates the assembly of the upper radiating element of the embodiment of FIGS. 10–15. The male contact (contacts 72–74) is soldered to the brass tube 78. The nickel-titanium wire 62 has a metallic lower contact. Metal wire 62, with the contact 84 crimped thereon, is inserted into the brass tube 78, as illustrated in FIG. 16. At that time, the contact 72 is then soldered over the end of the tube 78. Bushing 86 is then crimped onto or soldered to the upper end of the wire tube 62. Overmolded cap 64 covers the bushing 86 as previously described.

FIG. 16 illustrates an alternative embodiment for a flexible upper radiator with the addition of a wire coil form 80 which transmits the electrical energy from the contacts 72 and 74 to the tube 82. The configuration illustrated in FIG. 15 permits for the flexing of the upper radiator and takes the stress from the knuckle and the hinge pin, thus increasing cycle life and longevity of the product. In other words, in the embodiment of FIGS. 10–14, the tube 78 is a continuous tube and is not permitted any flexing. Although a flexible braid or other material could be used in lieu of a solid tube, the plated tube provides the highest antenna efficiency. In the embodiment of FIG. 15, the tube 78 is replaced by a split tube 82, with the wire coil form 80 providing the connection between the upper and lower members of the tube 82.

Thus it can be seen that the invention accomplishes at least all of its stated objectives.

I claim:

1. An antenna for use with a PCMCIA card, comprising:

a coaxial connector for electrical connection to the PCMCIA card;

an elongated coaxial cable electrically connected at one end to said coaxial connector;

said coaxial cable including a center wire and a metal braid;

an elongated housing having first and second ends and upper and lower portions;

a first printed circuit board in said housing which creates a lower radiator assembly;

a second printed circuit board positioned outwardly of said housing which creates an upper radiator assembly;

said first printed circuit board including at least one trace thereon;

said second printed circuit board including at least one trace thereon;

a transitionary member electrically connecting the trace on said first printed circuit board with the trace on said second printed circuit board;

said center wire of said coaxial cable being electrically connected to said transitionary member;

said metal braid of said coaxial cable being electrically connected to the trace on said first printed circuit board;

an electrically insulated sheath enclosing said second printed circuit board;

a joint member pivotally secured to said housing which at least partially encloses said transitionary member whereby said upper radiator assembly which is enclosed in said sheath may be pivotally moved with respect to said housing, between stowed and deployed positions.

2. The antenna of claim 1 wherein said printed circuit boards are flexible.

3. The antenna of claim 1 wherein the trace on said first printed circuit board functions as a counterpoise.

4. The antenna of claim 1 wherein said transitionary member is flexible.

5. The antenna of claim 1 wherein said joint member includes detent means for selectively maintaining said upper radiator assembly in its stowed position and in its deployed position.

6. The antenna of claim 5 wherein said upper radiator assembly is elongated and wherein the longitudinal axis thereof is positioned at a 90° angle with respect to said lower radiator assembly when said upper radiator assembly is in it deployed position.

7. The antenna of claim 1 wherein said upper radiator assembly includes upper and lower portions which are selectively pivotally secured together whereby said upper and lower portions may be positioned in a superposed position or may be positioned in an end-to-end relationship.

8. The antenna of claim 1 wherein said upper radiator is flexible.

9. The antenna of claim 8 wherein said upper radiator comprises first and second elongated radiator elements which are electrically and mechanically connected together.

* * * * *